US008904910B2

(12) United States Patent
Marsden et al.

(10) Patent No.: US 8,904,910 B2
(45) Date of Patent: Dec. 9, 2014

(54) CAULKING GUN WITH TIP CUTTER MECHANISM

(71) Applicant: The Sherwin-Williams Company, Cleveland, OH (US)

(72) Inventors: Andrew K. Marsden, Avon, OH (US); Dennis P. De Renzo, Jr., Concord Township, OH (US); James E. Szpak, Cleveland Heights, OH (US); Charles T. Buckel, Jr., Valley City, OH (US)

(73) Assignee: The Sherwin-Williams Company, Cleveland, OH (US)

( * ) Notice: Subject to any disclaimer, the term of this patent is extended or adjusted under 35 U.S.C. 154(b) by 139 days.

(21) Appl. No.: 13/723,836

(22) Filed: Dec. 21, 2012

(65) Prior Publication Data

US 2013/0160621 A1 Jun. 27, 2013

Related U.S. Application Data

(60) Provisional application No. 61/578,644, filed on Dec. 21, 2011.

(51) Int. Cl.
*B25B 33/00* (2006.01)

(52) U.S. Cl.
USPC ..... 83/54; 30/1; 30/123

(58) Field of Classification Search
USPC ..... 30/123, 112, 1, 173, 233, 238, 30/90.1–91.2; 83/13, 54
See application file for complete search history.

(56) References Cited

U.S. PATENT DOCUMENTS

| | | | | | |
|---|---|---|---|---|---|
| 1,388,398 | A | * | 8/1921 | Adams | 7/107 |
| 2,566,434 | A | * | 9/1951 | Toth et al. | 451/540 |
| 3,105,614 | A | * | 10/1963 | Sherbondy | 222/82 |
| 4,009,804 | A | | 3/1977 | Costa et al. | |
| 4,126,251 | A | | 11/1978 | Subwick | |
| 4,135,644 | A | * | 1/1979 | Pacetti | 222/81 |
| 4,158,914 | A | * | 6/1979 | Kurtz | 30/359 |
| 4,271,593 | A | * | 6/1981 | Smith | 30/233 |
| 4,356,938 | A | | 11/1982 | Kayser | |
| 4,390,115 | A | | 6/1983 | Bigham | |
| 4,461,407 | A | | 7/1984 | Finnegan | |
| 4,493,437 | A | | 1/1985 | Breeden | |
| 4,572,409 | A | | 2/1986 | Finnegan | |

(Continued)

FOREIGN PATENT DOCUMENTS

JP 55163070 U 11/1980

OTHER PUBLICATIONS

PCT International Search Report, International Application No. PCT/US2012/071425, Mar. 22, 2013.

(Continued)

*Primary Examiner* — Sean Michalski
(74) *Attorney, Agent, or Firm* — Deron A. Cook; Robert E. McDonald; Daniel A. Sherwin

(57) ABSTRACT

A caulking gun may have a tip cutter mechanism that is supported to the body of the caulking gun and that has a blade with a cutting edge. When the dispensing tip of a caulk tube is properly positioned with respect to the body, the blade may be moved with respect to the body to contact the dispensing tip with the cutting edge and cut the dispensing tip of the caulk tube to adjust the amount of caulk material that is dispensed.

14 Claims, 17 Drawing Sheets

(56) References Cited

U.S. PATENT DOCUMENTS

| | | | | | |
|---|---|---|---|---|---|
| 4,678,107 | A | | 7/1987 | Ennis, III | |
| 4,706,853 | A | | 11/1987 | Stonesifer et al. | |
| 4,802,607 | A | * | 2/1989 | Johnson | 222/82 |
| 4,834,268 | A | | 5/1989 | Keller | |
| 4,835,862 | A | * | 6/1989 | Phillips | 30/90.1 |
| 4,923,096 | A | | 5/1990 | Ennis, III | |
| 5,022,563 | A | * | 6/1991 | Marchitto et al. | 222/327 |
| 5,079,838 | A | * | 1/1992 | Stallings, Jr. | 30/1.5 |
| 5,197,635 | A | * | 3/1993 | Chang | 222/137 |
| 5,236,105 | A | | 8/1993 | Galex | |
| 5,482,189 | A | | 1/1996 | Dentler et al. | |
| 5,529,225 | A | | 6/1996 | Chang | |
| 5,553,754 | A | | 9/1996 | Dentler | |
| 5,595,327 | A | | 1/1997 | Dentler et al. | |
| 5,615,807 | A | | 4/1997 | Peng | |
| 5,653,363 | A | | 8/1997 | Chang | |
| 5,704,518 | A | | 1/1998 | Vanmoor | |
| 5,788,126 | A | | 8/1998 | Chang | |
| 5,815,925 | A | | 10/1998 | Chang | |
| 5,860,568 | A | * | 1/1999 | Mallalieu et al. | 222/83.5 |
| 5,887,765 | A | | 3/1999 | Broesamle | |
| 5,934,506 | A | | 8/1999 | Van Moerkerken | |
| 6,045,005 | A | * | 4/2000 | Stratton | 222/83.5 |
| 6,056,156 | A | * | 5/2000 | Peng | 222/82 |
| 6,155,463 | A | | 12/2000 | Dentler | |
| 6,253,969 | B1 | | 7/2001 | Nelson et al. | |
| 6,260,737 | B1 | | 7/2001 | Gruendeman | |
| 6,264,071 | B1 | | 7/2001 | Dentler | |
| 6,349,857 | B1 | | 2/2002 | Lepsius et al. | |
| 6,672,489 | B1 | | 1/2004 | Huang | |
| 6,691,899 | B2 | * | 2/2004 | Sung | 222/391 |
| D511,445 | S | | 11/2005 | Childs et al. | |
| 7,011,238 | B1 | | 3/2006 | Sung | |
| 7,073,691 | B2 | | 7/2006 | Rumrill et al. | |
| 7,418,785 | B2 | * | 9/2008 | Whitemiller et al. | 30/182 |
| 7,757,904 | B2 | * | 7/2010 | Rumrill et al. | 222/391 |
| 2004/0206784 | A1 | * | 10/2004 | Chen | 222/391 |
| 2005/0263544 | A1 | * | 12/2005 | Chang et al. | 222/391 |
| 2007/0017935 | A1 | * | 1/2007 | Rumrill et al. | 222/391 |
| 2010/0175266 | A1 | * | 7/2010 | Fischer | 30/92 |
| 2010/0180473 | A1 | * | 7/2010 | Rosenberger | 36/136 |
| 2013/0160621 | A1 | * | 6/2013 | Marsden et al. | 83/23 |
| 2013/0214013 | A1 | * | 8/2013 | Milan | 222/538 |
| 2014/0084022 | A1 | * | 3/2014 | Paul et al. | 222/80 |

OTHER PUBLICATIONS

PCT Written Opinion of the International Searching Authority, International Application No. PCT/US2012/071425, Mar. 22, 2013.

* cited by examiner

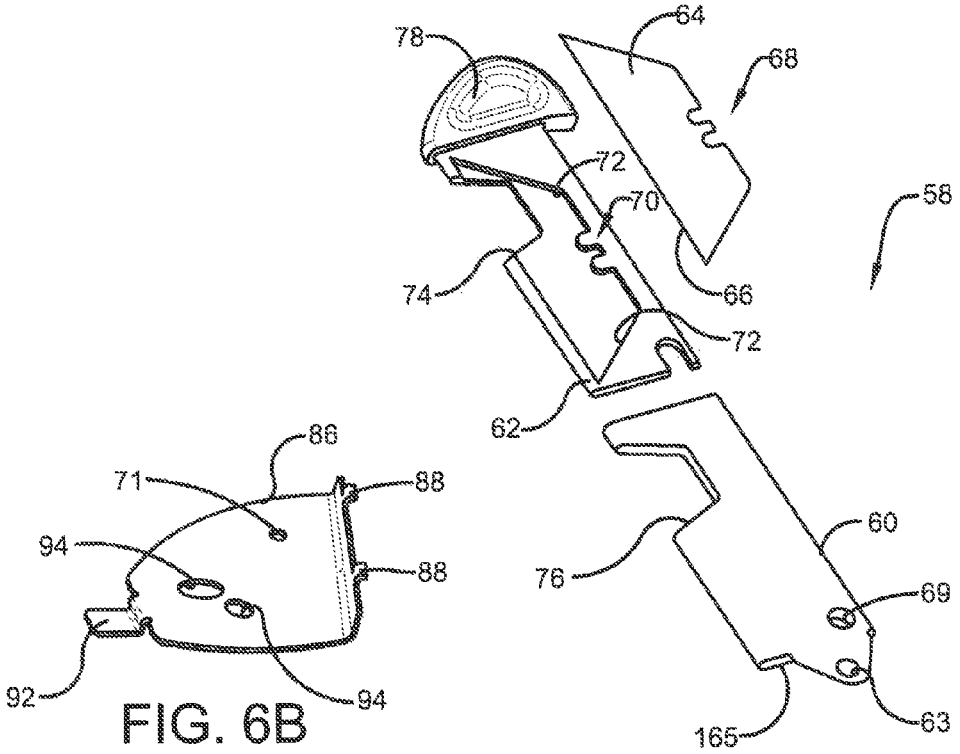
FIG. 6A
FIG. 6B
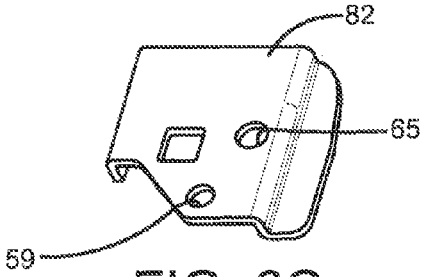
FIG. 6C
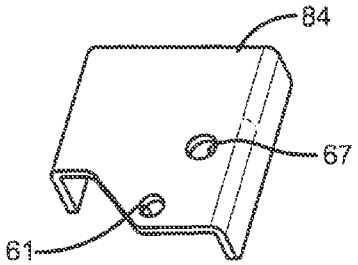
FIG. 6D

CAULKING GUN WITH TIP CUTTER MECHANISM

This utility patent application claims priority from the U.S. provisional patent application Ser. No. 61/578,644 titled CAULKLNG GUN which was filed on Dec. 21, 2012 and which is incorporated herein by reference.

I. BACKGROUND OF THE INVENTION

A. Field of Invention

This invention pertains to methods and apparatuses related to material dispensing and more specifically to methods and apparatuses related to hand-held caulking guns.

B. Description of the Related Art

Hand-held material dispensing devices, such as caulking guns, are well known in the art and generally rely on the action of a piston to push caulk material out of a caulk tube towards the application area. The motion of the piston is induced by the advancement of a piston rod in the direction of the receptacle, with the piston rod being advanced in the direction of travel by the operator's squeezing of a trigger.

While many known caulking guns work well for their intended purposes, it is desirable to improve their performance and applicability.

II. SUMMARY

According to one embodiment of this invention, a caulking gun for use with an associated caulk tube comprising a canister and a dispensing tip through which caulk material in the canister is dispensed, may comprise: (A) a body having a tube housing for housing the associated caulk tube while caulk material is dispensed; (B) a piston assembly that is supported to the body and that comprises: (1) a piston rod; and, (2) a piston attached to the piston rod; (C) a trigger mechanism that is supported to the body and that comprises: (1) a trigger that: (a) comprises a contact surface; and, (b) is movable with respect to the body; and, (2) an advance plate that grips the piston rod; and, (D) a tip cutter mechanism, supported to the body, and comprising a blade having a cutting edge. The trigger mechanism may be operable by moving the trigger with respect to the body to contact the advance plate with the second contact surface of the control cam to move the piston rod and the piston to cause the caulk material to dispense through the dispensing tip. The dispensing tip may be positioned properly with respect to the blade and the blade may then be movable with respect to the body to contact the dispensing tip with the cutting edge and cut the dispensing tip of the associated caulk tube to adjust the amount of caulk material that is dispensed.

According to another embodiment of this invention, a caulking gun for use with an associated caulk tube comprising a canister and a dispensing tip through which caulk material in the canister is dispensed, may comprise: (A) a body having a tube housing for housing the associated caulk tube while caulk material is dispensed; (B) and, (C) a tip cutter mechanism, supported to the body, and comprising a blade having a cutting edge. The dispensing tip may be positioned properly with respect to the blade and the blade may then be movable with respect to the body to contact the dispensing tip with the cutting edge and cut the dispensing tip of the associated caulk tube to adjust the amount of caulk material that is dispensed.

According to yet another embodiment of this invention, a method of cutting the tip of a caulk tube may comprise the steps of: (A) providing a caulk tube comprising: (1) a canister; and, (2) and a dispensing tip through which caulk material in the canister is dispensed; (B) providing a caulking gun comprising: (1) a body having a tube housing that houses the caulk tube while caulk material is dispensed; and, (2) a tip cutter mechanism comprising a blade that: (a) is supported to the body; and, (b) has a cutting edge; (C) positioning the dispensing tip properly with respect to the blade; and, (D) moving the blade with respect to the body, while being supported to the body, to contact the dispensing tip with the cutting edge and cut the dispensing tip to adjust the amount of caulk material that is dispensed.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein:

FIG. 6A is an assembly view of a blade holder assembly.

FIG. 6B is a perspective view of a blade cover.

FIG. 6C is a perspective view of a support bracket.

FIG. 6D is a perspective view of a support bracket.

IV. DETAILED DESCRIPTION OF THE INVENTION

Figure 1:
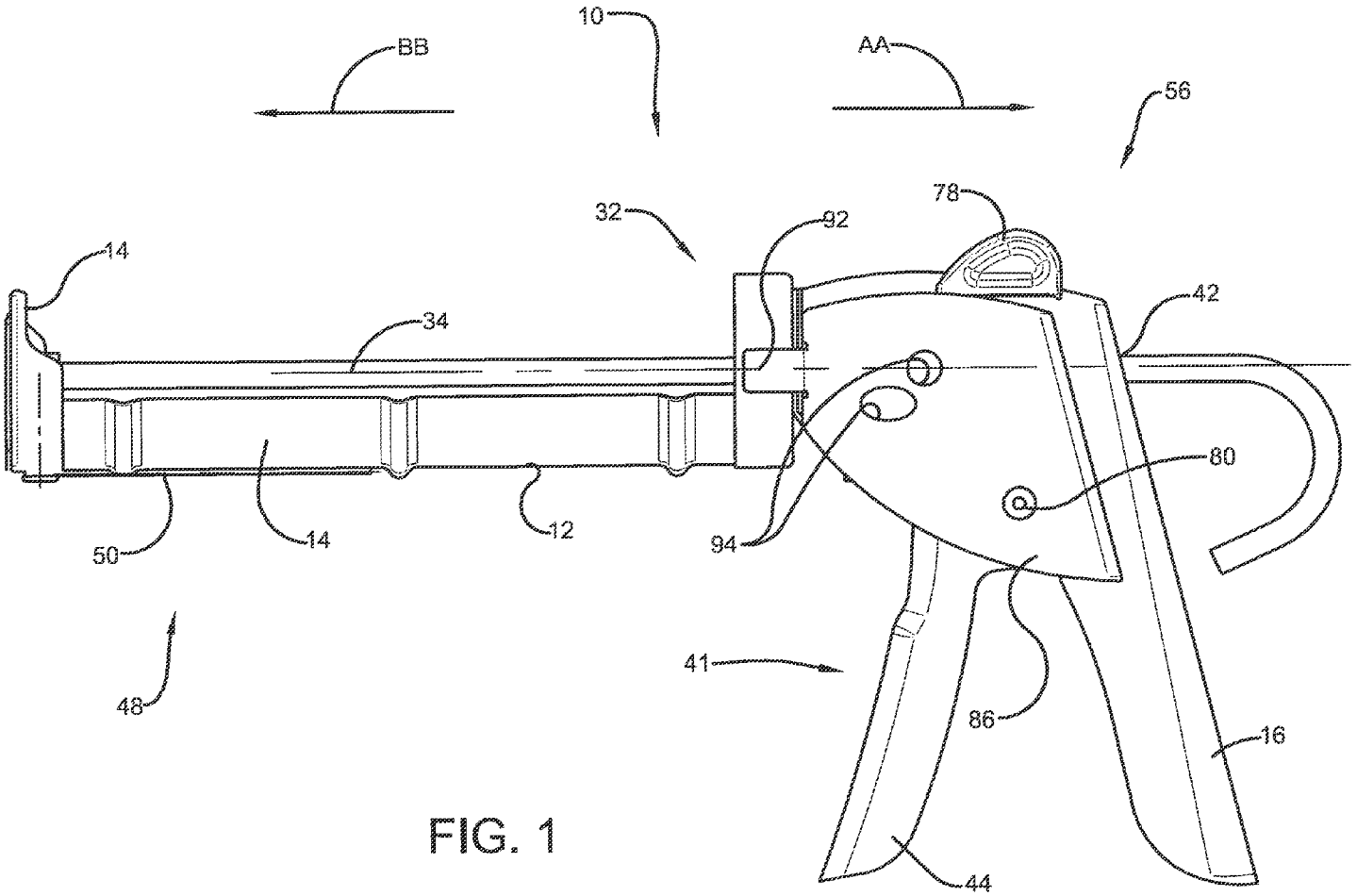
FIG. 1 is a side view of a caulking gun.
Figure 2:
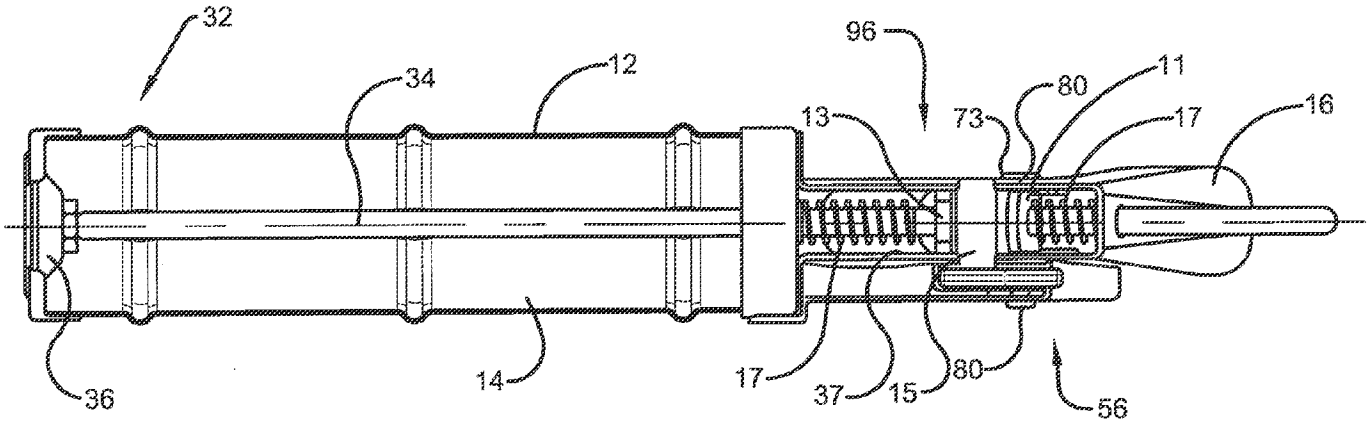
FIG. 2 is a top view of the caulking gun shown in FIG. 1.
Figure 3:
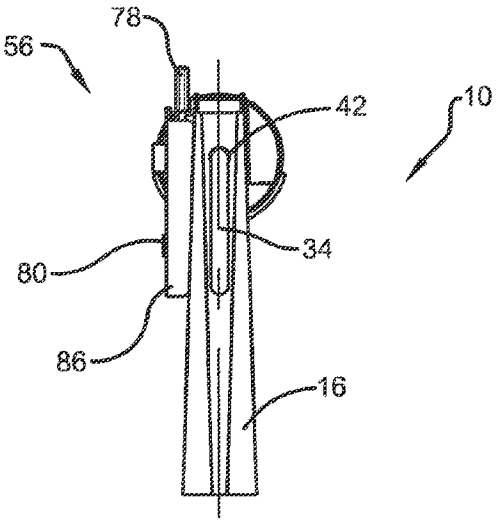
FIG. 3 is a distal view of the caulking gun shown in FIG. 1.
Figure 4:
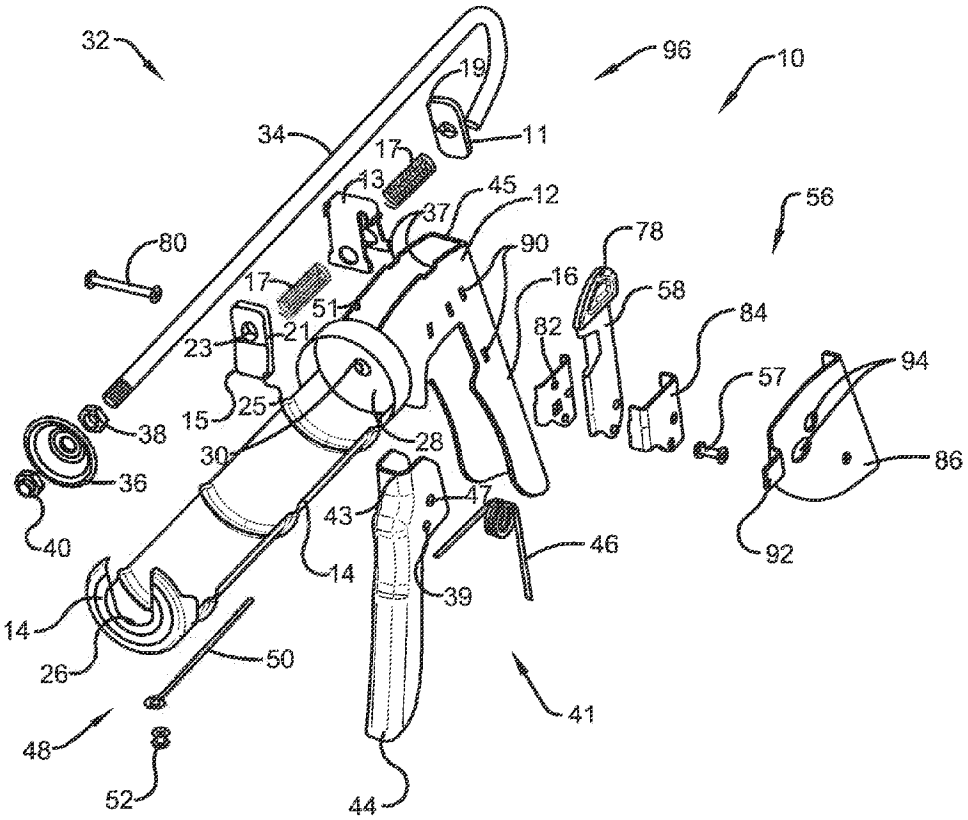
FIG. 4 is an assembly view of the caulking gun shown in FIG. 1.

Referring to the drawings wherein the showings are for purposes of illustrating embodiments of the invention only and not for purposes of limiting the same, and wherein like reference numerals are understood to refer to like components, FIGS. 1-4 shows a caulking gun 10 that includes some embodiments of this invention. The caulking gun 10 may include a body 12 having a tube housing 14 and a handgrip 16. For purposes of describing relative orientation only, in this patent the word "proximal" will mean the direction toward the handgrip 16 (direction AA in FIG. 1) and the word "distal" will mean the direction toward the tube housing 14 (direction BB in FIG. 1). The tube housing 14 may be used to hold a caulk tube, such as caulk tube 18 shown in FIG. 5. It should be noted that while forms of the word "caulk" are used throughout this patent, this invention is not to be limited to any particular type of material. Any material chosen with the sound judgment of a person of skill in the art can be used with the caulking guns of this invention. The caulk tube 18, as is well known to those in the art, may include a canister 20, which may be cylindrically shaped, and a dispensing tip 22 through which the caulk material within the canister 20 is dispensed. The end of the canister 20 opposite the dispensing tip 22 may have a contact surface 49 that can be pushed relative to the canister 20 to force the caulk material out through the dispensing tip 22. The dispensing tip 22 may be substantially frustoconical in shape, as shown, and may be closed or sealed to prevent the caulk material from exiting the canister 20 until it is desired to dispense the caulk material. The caulk tube 18 may be placed within the tube housing 14 with the dispensing tip 22 extending distally from the distal end of the tube housing 14, as is well known to those of skill in the art. The distal end of the tube housing 14 may have a first wall 24 with a slot 26 that receives the dispending tip 22 of the caulk tube 18. The proximal end of the tube housing 14 may have a second wall 28 with an aperture 30. The opposite ends of the canister 20 may be supported against the first and second walls 24, 28 as is well known. The tube housing 14 may have a cylindrical shape, as shown, to match the cylindrical shape of the canister 20. While the body 12 may be formed in any manner and of any material chosen with the sound judgment of a person of skill in the art, for the embodiment shown the body 12 is formed of steel in a stamping operation.

With reference to FIGS. 1-4, the caulking gun 10 may also include a piston assembly 32 which is used to push the caulk material out of the caulk tube 18. The piston assembly 32 may include a piston rod 34 and a piston 36. The distal end of the piston rod 34 may be inserted through an aperture 42 in the proximal end of the body 12 and through the aperture 30 in the second wall 28. The apertures 30, 28 may be collinear. A jam nut 38 and locknut 40 may be used to attach the piston 36 to the threaded distal end of the piston rod 34. The proximal end of the piston rod 34 may be curved, as shown, thus serving as a handle for the user of the caulking gun 10 to use as is well known to those of skill in the art.

With continuing reference to FIGS. 1-4, the caulking gun 10 may also have a trigger mechanism 41 that may be operated by a user to cause the caulking gun 10 to dispense the caulk material. The trigger mechanism 41 may include a trigger 44 that is pivotally attached to the body 12 and a trigger spring 46 that is positioned between the trigger 44 and the handgrip 16. The trigger spring 46 biases the trigger 44 toward a "non-triggered" or non-dispensing position. To dispense the caulk material, the user simply moves (or squeezes) the trigger 44 toward the handgrip 16, thereby overcoming the biasing force of the trigger spring 46. The trigger 44 may have a pair of holes 39, 47, and a contact surface 43, as shown. While the trigger 44 may be formed in any manner and of any material chosen with the sound judgment of a person of skill in the art, for the embodiment shown the trigger 44 is formed of steel. Additional details as to the assembly and operation of the trigger mechanism 41 will be described below.

With reference now to FIGS. 1-5, the caulking gun 10 may also have a seal punch mechanism 48 that includes a punch rod 50 attached to the body 12 with a connector 52. For the embodiment shown, the connector 52 holds the punch rod 50 to a bottom surface of the distal end of the tube housing 14. In one embodiment, the connector 52 provides a pivotal connection for the punch rod 50. The distal end of the punch rod 50 (the end distant from the connector 52) may be used to pierce or puncture the distal end 54 of the dispensing tip 22 so that the caulk material can be dispensed from the caulk tube 18.

With reference now to FIGS. 1-6, because of the frustoconical shape of the dispensing tip 22 (discussed above), cutting off the distal end of the dispensing tip 22 at different longitudinal distances from the distal end 54 and/or at different angles provides for different dispensing characteristics. Prior to this invention, it was only known to use a separate knife or other such cutting blade to cut off the distal end of the dispensing tip 22. While the use of a separate knife generally works adequately, it is problematic to achieve the desired cut because of the difficulty in supporting the caulk tube 18 as the knife is used to cut the dispensing tip 22. It also requires that the user obtain the separate knife. To greatly reduce these problems, the caulking gun 10 may include a tip cutter mechanism 56, supported to the body 12, which can be used to cut the dispensing tip 22 of the caulk tube 18 to adjust the amount of caulk material that is dispensed. The tip cutter mechanism 56 may include a blade holder assembly 58, seen best in FIG. 6A, that may have a blade holder sleeve 60, a blade holder 62 and a blade 64. In one embodiment, the blade 64 is a razor blade having a cutting edge 66 and an engagement feature 68. The engagement feature 68 of the blade 64 matches an engagement feature 70 of the blade holder 62 to ensure that only the correct blade 64 can be engaged to (and used with) the blade holder 62. The blade holder 62 may have a cutout area 72 shaped to match the shape of the blade 64. Once the blade 64 is positioned within the cutout area 72, the blade holder 62 may be inserted into the blade holder sleeve 60. The blade holder 62 may have a handle 78 that makes it easy to insert and remove the blade holder 62 with respect to the blade holder sleeve 60 and to operate the tip cutter mechanism 56 as will be explained below.

With continuing reference to FIGS. 1-6, both the blade holder 62 and the blade holder sleeve 60 may have a notch 74, 76, respectively, so that a portion of the cutting edge 66 of the blade 64 is exposed for use. A support bracket 82, 84, seen best in FIGS. 6C and 6D, may be positioned on each side of the blade holder assembly 58, as shown, to help support the blade holder assembly 58 to the body 12. A connector 57, such as a rivet, may be received in holes 59, 61 formed in the support brackets 82, 84, hole 63 formed in the blade holder sleeve 60 and hole 39 formed in the trigger 44, as shown, to connect the brackets 82, 84 and the blade holder sleeve 60 to the caulking gun 10. A blade cover 86, seen best in FIG. 6B, may be positioned on the outermost side surface of the calking gun 10, as shown, to cover or protect the blade 64. The blade cover 86 may have at least one tab 88, two shown, that is received in a corresponding tab receiving slot 90, two shown, to hold the blade cover 86 in a fixed position to the body 12. The blade cover 86 may have another tab 92 that abuts the proximal end of the tube housing 14, as shown. A pivot pin 80, such as a rivet, may be used to pivotally attach the blade holder assembly 58 to the body 12. The pivot pin 80 may be received in hole 71 formed in the blade cover 86, hole 67 formed in the support bracket 84, hole 69 formed in the blade holder sleeve 60, hole 65 formed in the support bracket 82, hole 47 formed on one side of the trigger 44, another hole (not visible) on the other side of the trigger 44 and a hole 73 formed in the body 12 on the opposite side of the blade cover 86, as shown. With this arrangement the pivot pin 80 also may be used as the pivotal attachment for the trigger 44 to the caulking gun 10.

Still referring to FIGS. 1-6, the blade cover 86 may also have at least one tip reception opening 94, two shown. For the embodiment shown, the two tip reception openings 94, 94, have different shapes. One is circular in shape and the other is oval in shape. This provides additional options for the user to obtain differing dispensing characteristics with the caulking tube 18. Any shape and size for the tip reception opening(s) chosen with the sound judgment of a person of skill in the art may be used with this invention. To use the tip cutter mechanism 56, the dispensing tip 22 of the caulk tube 18 is inserted a desired amount into the desired tip reception opening 94 or 94. The blade holder assembly 58 is then pivoted with respect to the body 12, using the handle 78 if desired, and the cutting edge 66 of the blade 64 contacts and cuts off the distal end of the dispensing tip 22 to achieve a desired dispensing characteristic. The caulk tube 18 is then placed into the tube housing 14. When the blade 64 wears out, it may be rotated so that the opposite end of the cutting edge 66 is exposed through the notches 74, 76 anchor the blade 64 can be replaced.

With reference to FIGS. 1-5 and 7, one known problem with caulking guns is that the caulk material may continue to leak or drip out of the dispensing tip 22 after the user has released the trigger mechanism 41. To greatly reduce this problem, the caulking gun 10 may include a drip free mechanism 96 that is supported to the body 12 and that can be used to prevent the caulk material from dripping. The drip free mechanism 96 may include a first dog plate 11, a dog bracket 13, a second dog plate 15 and a pair of compression springs 17, 17. The first dog plate 11 may be a substantially planar component with a hole 19 positioned in the center, as shown. The second dog plate 15 may have a top portion 21 with a hole 23 and a bottom portion 25 that is angled from the top portion 21. The angle may be less than 25 degrees. In one embodiment, the angle is less than 10 degrees and, for the embodiment shown, the angle is approximately 5 degrees. The dog bracket 13, seen best in FIG. 7, may be generally U-shaped with first and second sides 27, 29 and a midsection 31. The first side 27 may be angled at an angle A1 with respect to a line that is perpendicular to the midsection 31, as shown. The angle A1 may be less than 25 degrees and for the embodiment shown the angle A1 is approximately 10 degrees. Each side 27, 29 may have a hole 33. Each end of the midsection 31 may have an extension 35, as shown.

With reference to FIGS. 1-4 and 7, to assembly the drip free mechanism 96, the extensions 35 on the dog bracket 15 may be received in notches 37 formed on an upper surface of the body 12, as shown. The distal end of the piston rod 34 may be inserted through the aperture 42 in the proximal end of the body 12, through one of the springs 17, through the hole 19 in the first dog plate 11, through the holes 33, 33 in the dog bracket 13, through the hole 23 in the second dog plate 15, through the other spring 17 and through the aperture 30 in the second wall 28 of the tube housing 14. In this way the drip free mechanism 96 is housed within a chamber 51 of the body 12, as shown, with the distal end of the distal spring 17 contacting the proximal side of the second wall 28 of the tube housing 14 and the proximal end of the proximal spring 17 contacting the distal side of a proximal wall 45 of the body 12. The dog bracket 13 may be oriented with the first side 27 facing proximally and the second dog plate 15 may be oriented with the angled bottom portion 25 facing and angling distally, as shown.

With reference to FIGS. 1-5 and 7, as noted above, to dispense the caulk material, the user simply moves (or squeezes) the trigger 44 toward the handgrip 16, thereby overcoming the biasing force of the trigger spring 46. This motion of the trigger also causes the contact surface 43 to contact the proximal side of the angled bottom portion 25 of the second dog plate 15, which produces a force that causes the second dog plate 15 to twist and thus grip or engage the piston rod 34 thereby advancing the piston rod 34 in the distal direction. This movement of the piston rod 34 in the distal direction overcomes the biasing force of the distal spring 17 and pushes the piston 36 against the contact surface 49 of the canister 20 to force the caulk material out of the caulk tube 18—in proportion to the force or thrust applied to the trigger 44. The second dog plate 15 can thus be considered an advance dog plate.

With reference to FIGS. 1-4 and 7, once the desired amount of caulk material has been dispensed, the user simply releases the trigger 44 and the drip free mechanism 96 operates automatically to prevent additional caulk material from being dispensed. Specifically, when the user releases the trigger 44, the distal spring 17, which was compressed by the advancement of advance dog plate 15, now forces the advance dog plate 15 to move proximally. Because the distal spring 17 contacts the advance dog plate 15 substantially equally around the hole 23 formed in the top (non-angled) portion 21, the distal spring 17 acts evenly on the advance dog plate 15 permitting it to slide proximally along the piston rod 34 without gripping or engaging the piston rod 34. The advance dog plate 15 thus slides proximally along piston rod 34 until it contacts, and comes to rest against, the second (distal) side 29 of the dog bracket 13.

With continuing reference to FIGS. 1-4 and 7, the dog bracket 13, the proximal spring 17 and the first dog plate 11 prevent the piston rod 34 from moving distally until such motion is desired by moving (or squeezing) the trigger 44. This prevents additional dispensing of caulk material, that is, it prevents caulk material from leaking or dripping. Specifically, the proximal spring 17 applies a distal force to the first dog plate 11. This force keeps the first dog plate 11 against the proximal side 27 of the dog bracket 13. Because the proximal side 27 of the dog bracket 13 is angled, at angle A1, the first dog plate 11 is maintained at the same angle. Because the first dog plate 11 is angled, it grips or engages the piston rod 34, thereby holding or preventing the piston rod 34 from moving. The first dog plate 11 can thus be considered a hold dog plate. When the user moves (or squeezes) the trigger 44 causing the advance dog plate 15 to engage the piston rod 34 and move the piston rod 34 distally, the dog bracket 13 and hold dog plate 11 also move distally. This distal movement of the dog bracket 13 and hold dog plate 11 decompresses the proximal spring 17 which permits the hold dog plate 11 to assume a non-angled upright (substantially perpendicular to the piston rod 34) position. Thus, it is no longer held against the angled proximal side 27 of the dog bracket 13. This causes the hold dog plate 11 to cease gripping or engaging the piston rod 34, permitting the piston rod 34 to easily slide in the distal direction through the hole 19 in the hold dog plate 11.

Figure 5:
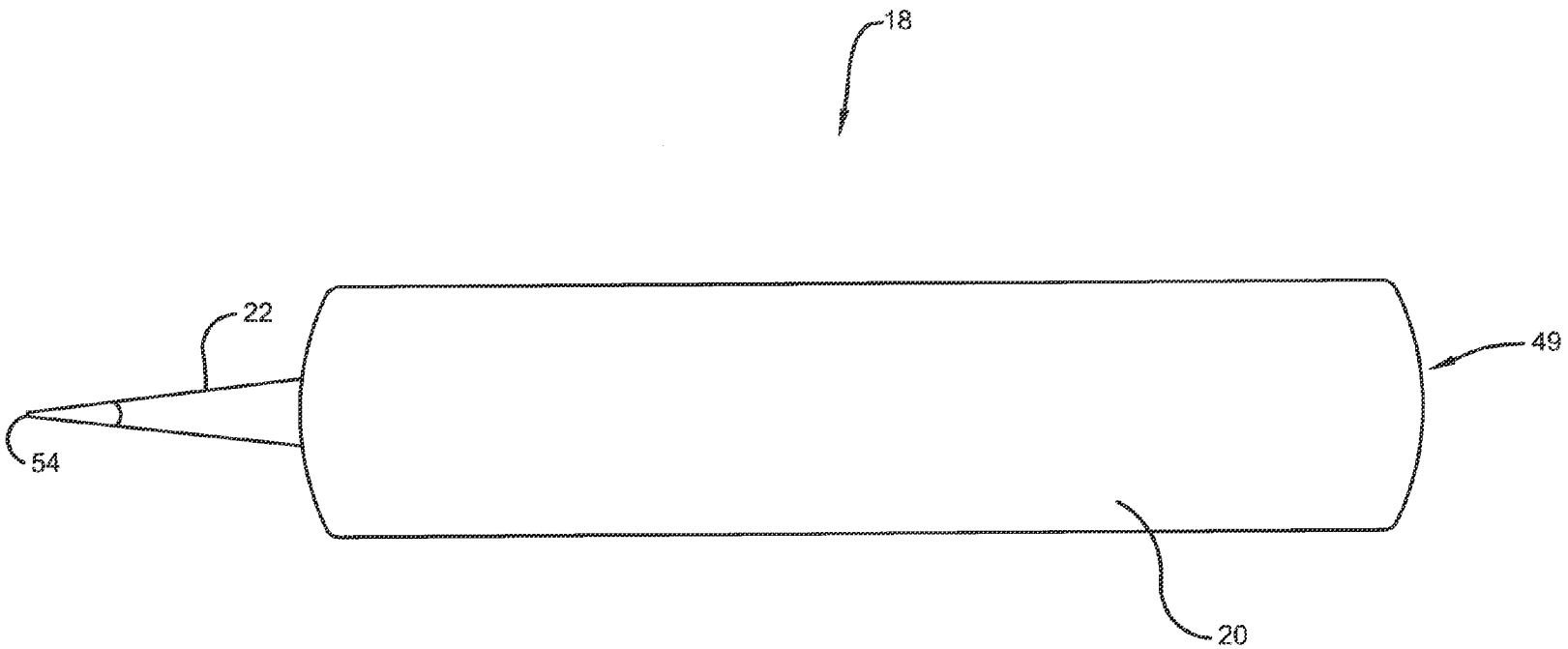
FIG. 5 is a side view of a caulk tube.
Figure 7A:
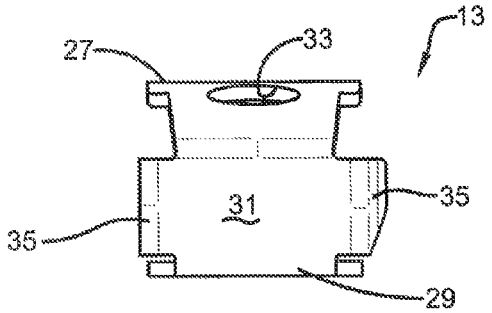
FIG. 7A is a top view of the dog bracket shown in FIG. 7C.
Figure 7C:
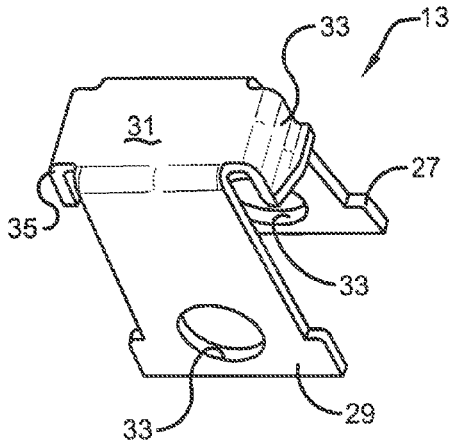
FIG. 7C is a perspective view of a dog bracket.
Figure 7B:
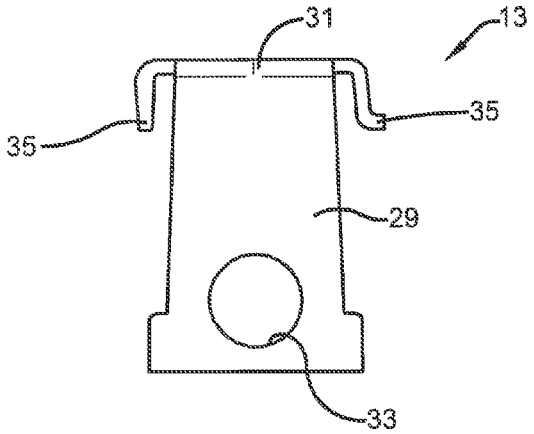
FIG. 7B is a side view of the dog bracket shown in FIG. 7C.
Figure 7D:
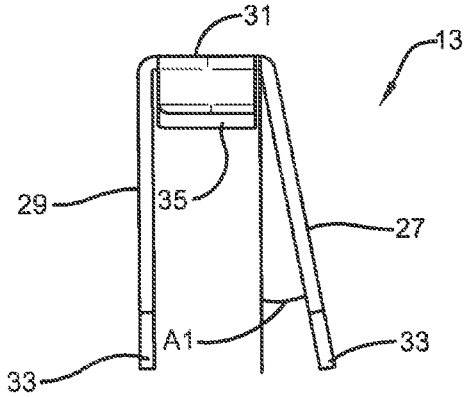
FIG. 7D is an end view of the dog bracket shown in FIG. 7C.
Figure 8A:
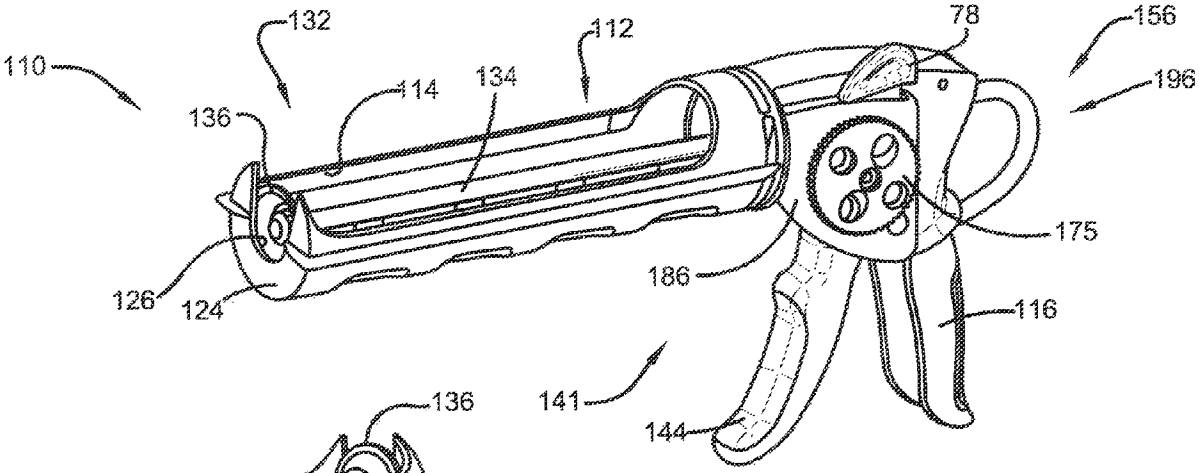
FIG. 8A is a first side view of a caulking gun.
Figure 8B:
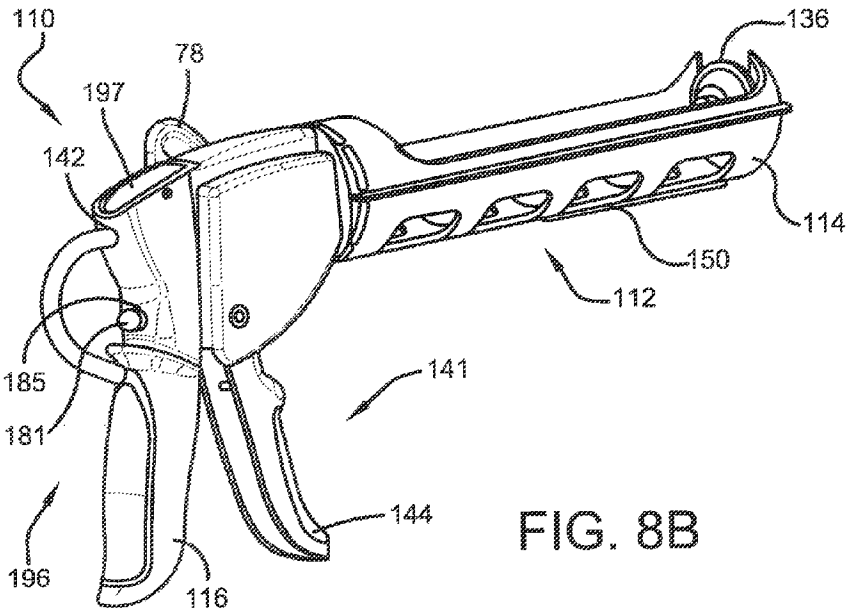
FIG. 8B is a second side view of the caulking gun shown in FIG. 8A.
Figure 9A:
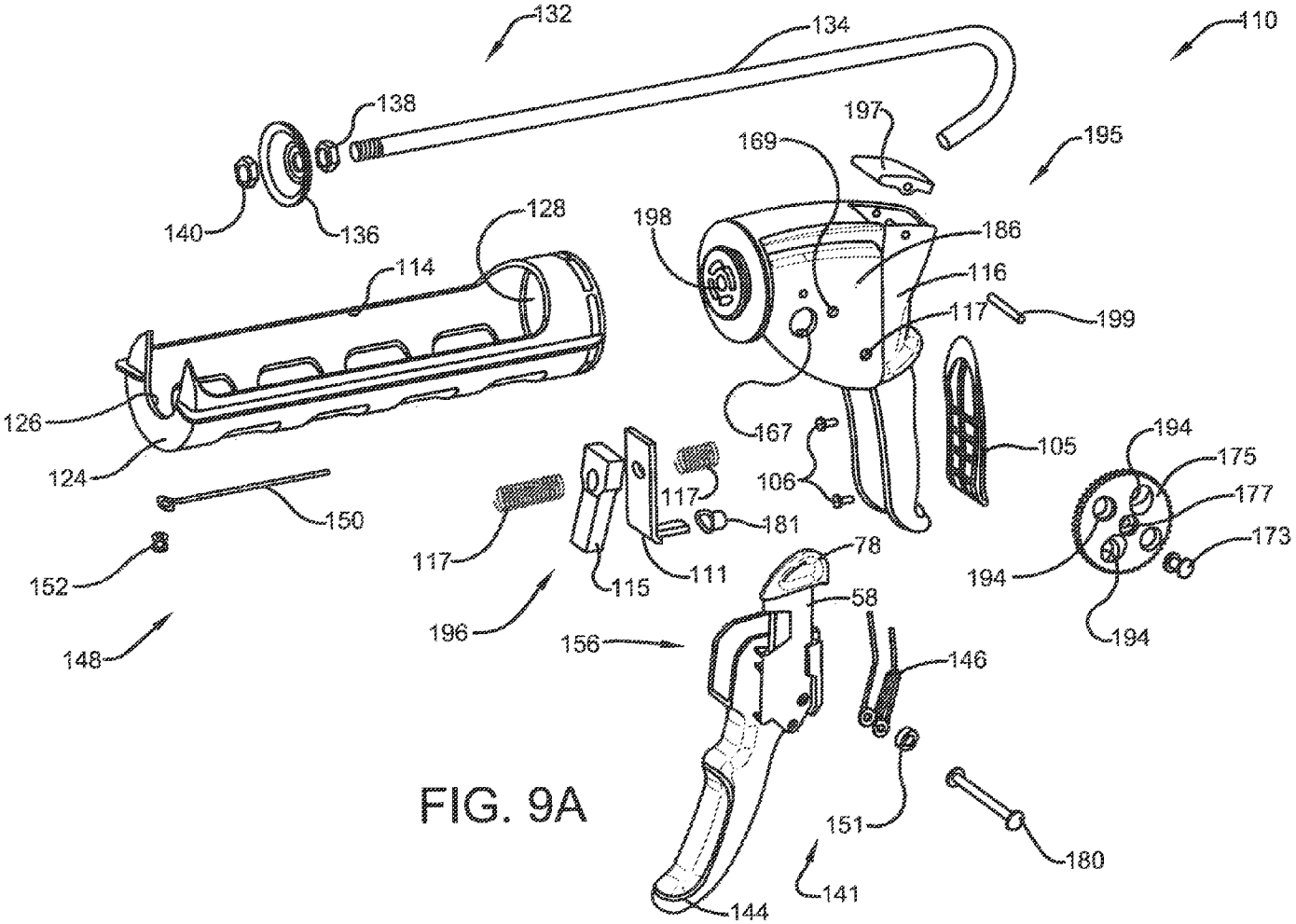
FIG. 9A is an assembly view of the caulking gun shown in FIG. 8A.
Figure 9B:
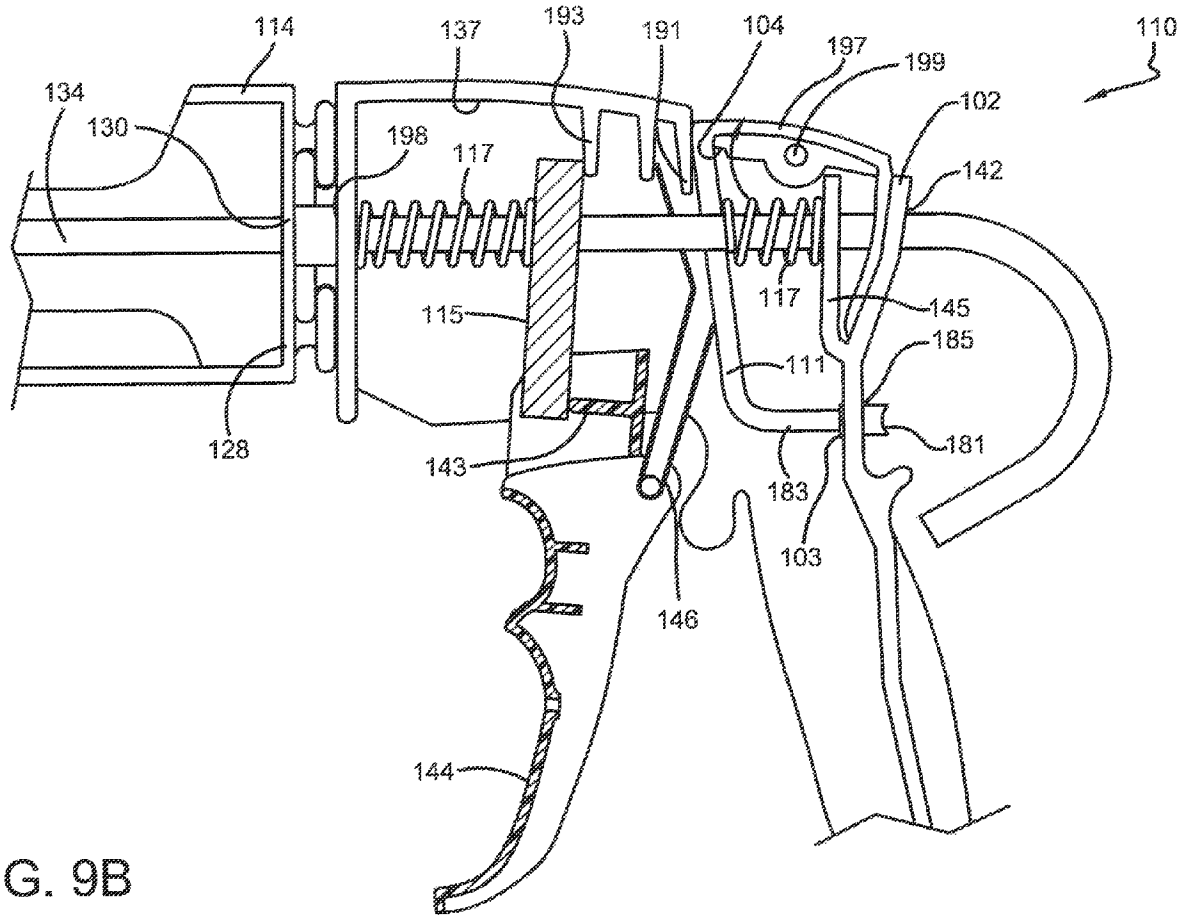
FIG. 9B is a longitudinally sectional view of the caulking gun shown in FIG. 8A.

With reference now to FIGS. 5 and 8-9, another caulking gun 110 that includes some embodiments of this invention will now be described. Caulking gun 110 has some components that are similar to those described above regarding caulking gun 10 and thus many reference numbers will be similar but with a "1" in the hundreds place added. Caulking gun 110 may include a body 112 having a tube housing 114 and a handgrip 116. For the embodiment shown, the tube housing 114 and handgrip 116 are separate components that are joined together. While the body 112 may be formed in any manner and of any material chosen with the sound judgment of a person of skill in the art, for the embodiment shown the body 112, both the tube housing 114 and the handgrip 116, are formed of plastic. The handgrip 116 may have a grip 105, which may be formed of rubber, attached to an outer surface of the handgrip 116 with connectors 106, 106, which may be screws, as shown. The grip 105 improves the friction for the user as is well known to those of skill in the art. The tube housing 114 may be used to hold a caulk tube, such as caulk tube 18 shown in FIG. 5. The distal end of the tube housing 114 may have a first wall 124 with a slot 126 that receives the dispending tip 22 of the caulk tube 18. The proximal end of the tube housing 114 may have a second wall 128 with an aperture 130 (shown in FIG. 9B). The opposite ends of the canister 20 may be supported against the first and second walls 124, 128 as is well known. The tube housing 114 may have a cylindrical shape, as shown, to match the cylindrical shape of the canister 20.

With reference to FIGS. 8-9, the caulking gun 110 may also include a piston assembly 132 which is used to push the caulk material out of the caulk tube 18. The piston assembly 132 may include a piston rod 134 and a piston 136. The distal end of the piston rod 134 may be inserted through an aperture 142 in the proximal end of the handgrip 116, an aperture 198 in the distal end of the handgrip 116 and through the aperture 130 in the second wall 128. A jam nut 138 and locknut 140 may be used to attach the piston 136 to the threaded distal end of the piston rod 134. The proximal end of the piston rod 134 may be curved, as shown, thus serving as a handle for the user of the caulking gun 110 to use as is well known to those of skill in the art.

Figure 10C:
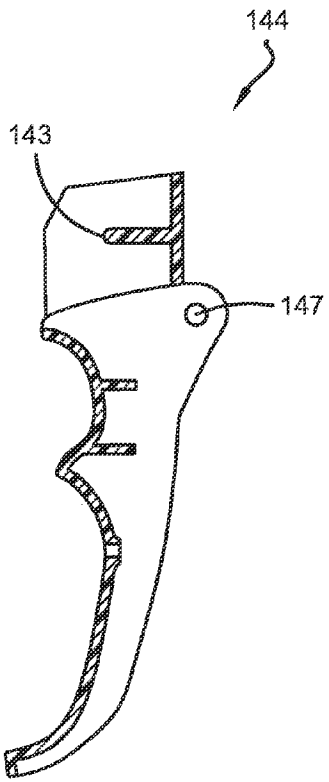
FIG. 10C is a sectional view taken along the line 10C-10C in FIG. 10B.
Figure 10B:
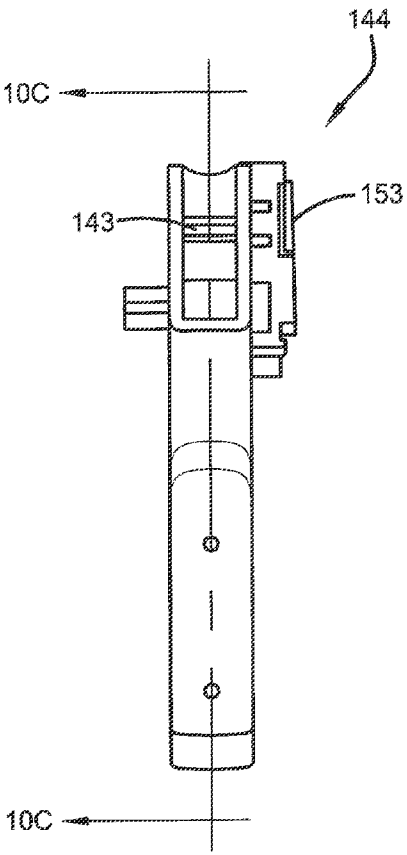
FIG. 10B is an end view of the trigger shown in FIG. 100.

With reference now to FIGS. 8-41, the caulking gun 110 may also have a trigger mechanism 141 that may be operated by a user to cause the caulking gun 110 to dispense the caulk material. The trigger mechanism 141 may include a trigger 144 that is pivotally attached to the handgrip 116 with pivot pin 180 and a trigger spring 146 that is positioned between the trigger 44 and the handgrip 116. While the trigger 144 may be formed in any manner and of any material chosen with the sound judgment of a person of skill in the art, for the embodiment shown the trigger 144 is formed of plastic. The trigger spring 146 biases the trigger 144 toward a "non-triggered" or non-dispensing position. To dispense the caulk material, the user simply moves (or squeezes) the trigger 144 toward the handgrip 116, thereby overcoming the biasing force of the trigger spring 146. A spacer 151 may be used with the trigger spring 146. As seen best in FIG. 11A, the trigger 144 may have a grip 161, which may be formed of rubber, attached to an outer surface of the trigger 144 with connectors 163, 163, which may be screws. The grip 161 improves the friction for the user as is well known to those of skill in the art. The trigger 144 may also have, as seen best in FIGS. 10A and 10B, a pair of holes 139, 147, a contact surface 143, a lip 153, a ledge 155 and at least one extension 157, two shown, that extends from a surface 159, as shown. The use of these components will be described below.

With reference to FIGS. 8-9, the caulking gun 110 may also have a seal punch mechanism 148 that includes a punch rod 150 attached to the tube housing 114 with a connector 152. For the embodiment shown, the connector 152 holds the punch rod 150 to a bottom surface of the distal end of the tube housing 114. In one embodiment, the connector 152 provides a pivotal connection for the punch rod 150. The distal end of the punch rod 152 (the end distant from the connector 152) may be used to pierce or puncture the distal end 54 of the dispensing tip 22 so that the caulk material can be dispensed from the caulk tube 18.

With reference now to FIGS. 5, 6A and 841, the caulking gun 110 may include a tip cutter mechanism 156, supported to the handgrip 116, that can be used to cut the dispensing tip 22 of the caulk tube 18 to adjust the amount of caulk material that is dispensed. The tip cutter mechanism 156 may include a blade holder assembly such as the blade holder assembly 58 shown in FIG. 6A and described above. To attach the blade holder assembly 58 to the trigger 144, a surface 165 of the blade holder sleeve 60 may rest on the ledge 155, shown in FIG. 10A. The blade holder sleeve 60 may thus be received between the lip 153 and the extensions 157. A connector (not shown), such as a rivet, may be received in hole 63 formed in the blade holder sleeve 60 and hole 139 formed in the trigger 144 to attach the blade holder sleeve 60 to the caulking gun 110. An outer surface of the handgrip 116 may define a blade cover 186, as shown. The pivot pin 180 may also be used to pivotally attach the blade holder assembly 58 to the handgrip 116. The pivot pin 180 may be received in hole 171 formed in the blade cover 186, as shown.

With reference to FIGS. 5, 6A, 8-9 and 12, the blade cover 186 may also have a pair of holes 167, 169, as shown. The hole 169 may used to receive a connector 173, which may be a rivet, to rotatably hold a cut-off wheel 175 to the blade cover 186. The cut-off wheel 175, seen best in FIG. 12, may have a hole 177 that receives the connector 173 and a plurality of tip reception openings 194, four shown. The cut-off wheel 175 may also have a textured outer surface 179 that makes it easy for the user to grip the cut-off wheel 175 to rotate the cut-off wheel 175. The tip reception openings 194 may have different shapes and/or different sizes and/or different angles. This provides numerous options for the user to obtain differing dispensing characteristics with the caulking tube 18. Any number, shape, angle and size for the tip reception openings 194 chosen with the sound judgment of a person of skill in the art may be used with this invention. To use the tip cutter mechanism 156, the cut-off wheel 175 is rotated until the desired tip reception opening 194 is aligned with the hole 167 in the blade cover 186. The dispensing tip 22 of the caulk tube 18 is then inserted a desired amount into the aligned tip reception opening 194. The blade holder assembly 58 is then pivoted with respect to the body 12, using the handle 78 if desired, and the cutting edge 66 of the blade 64 contacts and cuts off the distal end of the dispensing tip 22 to achieve a desired dispensing characteristic. The caulk tube 18 is then placed into the tube housing 114.

With reference now to FIGS. 8-9 and 13, the caulking gun 110 may include a drip free mechanism 196 that is supported to the handgrip 116 and that can be used to prevent the caulk material from dripping. The drip free mechanism 196 may include first and second dog plates 111, 115, a pair of biasing devices 117, 117, compression springs in the embodiment shown, and a release button 181. The first dog plate 111 may be a substantially planar component with a hole 119 and an extension 183 that extends from a bottom surface of the dog plate 111. The second dog plate 115 may have a top portion 121 with a hole 123 and a bottom portion 125 that is angled from the top portion 121. The angle may be less than 25 degrees. In one embodiment, the angle is less than 10 degrees and, for the embodiment shown, the angle is approximately 5 degrees.

With continuing reference to FIGS. 8-9 and 13, to assembly the drip free mechanism 196, the distal end of the piston rod 134 may be inserted through the aperture 142 in the proximal end of the body 12, through the interior opening in one of the springs 117, through the hole 119 in the first dog plate 111, through the hole 123 in the second dog plate 115, through the interior opening in the other spring 117, through the aperture 198 in the distal end of the handgrip 116 and through the aperture 130 in the second wall 128 of the tube housing 114. In this way the drip free mechanism 96 is housed within a chamber 137 of the handgrip 116, as shown in FIG. 9B, with the distal end of the distal spring 117 contacting the distal end of the handgrip 116 and the proximal end of the proximal spring 117 contacting the distal side of a proximal wall 145 of the handgrip 116. The first dog plate 111 may be oriented with the extension 183 facing proximately and the second dog plate 115 may be oriented with the angled bottom portion 125 facing and angling distally, as shown. The upper end of the first dog plate 111 may contact the proximal side of a first extension 191 extending from the handgrip 116 and the upper end of the second dog plate 115 may contact the distal side of a second extension 193 extending from the handgrip 116, as shown in FIG. 9B. The button 181 has an opening 187 that receives the extension 183 of the first dog plate 111. The button 181 also has a rim 103 and a contact surface 189. The contact surface 189 is extended through an opening 185 formed in the proximal end of the handgrip 116 and the rim 103 holds the button 181 to the handgrip 116.

With reference to FIGS. 5, 8-9 and 13, as noted above, to dispense the caulk material, the user simply moves (or squeezes) the trigger 144 toward the handgrip 116, thereby overcoming the biasing force of the trigger spring 146. This motion of the trigger also causes the contact surface 143 of the trigger 144 to contact the proximal side of the angled bottom portion 125 of the second dog plate 115, which produces a force that causes the second dog plate 115 to twist and thus grip or engage the piston rod 134 thereby advancing the piston rod 134 in the distal direction. This movement of the piston rod 34 in the distal direction overcomes the biasing force of the distal spring 117 and pushes the piston 136 against the contact surface 49 of the canister 20 to force the caulk material out of the caulk tube 18—in proportion to the force or thrust applied to the trigger 144. The second dog plate 115 can thus be considered an advance dog plate.

With reference to FIGS. 8-9 and 13, once the desired amount of caulk material has been dispensed, the user simply releases the trigger 144 and the drip free mechanism 196 operates automatically to prevent additional caulk material from being dispensed. Specifically, when the user releases the trigger 144, the distal spring 117, which was compressed by the advancement of advance dog plate 115, now forces the advance dog plate 115 to move proximally. Because the distal spring 117 contacts the advance dog plate 115 substantially equally around the hole 123 formed in the top (non-angled) portion 121, the distal spring 117 acts evenly on the advance dog plate 115 permitting it to slide proximally along the piston rod 134 without gripping or engaging the piston rod 134. The advance dog plate 115 thus slides proximally along piston rod 134 until it contacts, and comes to rest against, the distal side of the extension 193.

Still referring to FIGS. 8-9 and 13, the proximal spring 117 and the first dog plate 111 prevent the piston rod 134 from moving distally until such motion is desired. This prevents additional dispensing of caulk material, that is, it prevents caulk material from leaking or dripping. Specifically, the proximal spring 117 applies a distal force to the first dog plate 111. With the extension 183 attached to the button 181, this force keeps the first dog plate 111 angled against the proximal side of the extension 191, as shown in FIG. 91B. Because the first dog plate 111 is angled, it grips or engages the piston rod 134, thereby holding or preventing the piston rod 134 from moving. The first dog plate 111 can thus be considered a hold dog plate. To release the hold, the user simply presses button 181 distally. This distal movement of the button 181 causes the hold dog plate 111 to assume a non-angled upright (substantially perpendicular to the piston rod 134) position. This causes the hold dog plate 111 to cease gripping or engaging the piston rod 134, permitting the piston rod 134 to easily slide in the distal direction through the hole 119 in the hold dog plate 111.

With reference now to FIGS. 5, 8-9 and 14, as described above, it is sometimes undesirable for a caulking gun to leak or drip out of the dispensing tip 22 after the user has released the trigger mechanism 41. Other times, however, the continued dispensing of caulk material is desirable as the user can continue to apply the caulk material without having to use the trigger mechanism 41. To address this option, the caulking gun 110 may include an adjustment mechanism 195 that permits the user to adjust the drip free mechanism 196 between a drip free condition and a continuous application condition. The adjustment mechanism 195 may include a lever 197 that is pivotal about pivot pin 199 that is attached to an upper surface of the handgrip 116, as shown. The lever 197 may have a pair of holes 101 that receive the pivot pin 199.

With continuing reference to FIGS. 5, 8-9 and 14, the lever 197, when positioned generally horizontal as shown in FIG. 9B, is in the drip free condition. In this condition the proximal end of the lever 197 abuts a proximal wall 102 and the distal end of the lever 197 abuts the extension 191. The lever 197 may have a cavity 104 that receives the upper end of the dog plate 111, as shown. If the user presses the button 181 when the lever 197 is in the drip free condition, the lever 197 will prevent the dog plate 111 from moving to the non-angled upright (substantially perpendicular to the piston rod 134) position and thus the piston rod 134 will remain gripped or engaged by the dog plate 111. As a result, the piston rod 134 will not move, preventing further dispensing of the caulk material. If the user desires to place the adjustment mechanism 195 into the continuous application condition, the user simply presses down on the proximal side of the top surface of the lever 197. This causes the lever 197 to rotate in a clockwise direction CC, as shown in FIG. 9B. With the lever 197 thus rotated, the cavity 104 no longer receives the upper end of the dog plate 111. As a result, when the user then presses button 181 distally, the hold of the dog plate 111 is released, as described above. To place the adjustment mechanism 195 back into the drip free condition, the user only needs to press down on the distal side of the top surface of the lever 197. This causes the lever 197 to rotate in a counterclockwise direction, as shown in FIG. 9B, until the lever 197 is returned to the substantially horizontal position. While the adjustment mechanism 195 shown is used with the caulking gun embodiments of FIGS. 8-9, it is noted that such an adjustment mechanism 195 could be used with other embodiments, including the calking gun embodiments shown in FIGS. 1-4.

Figure 15A:
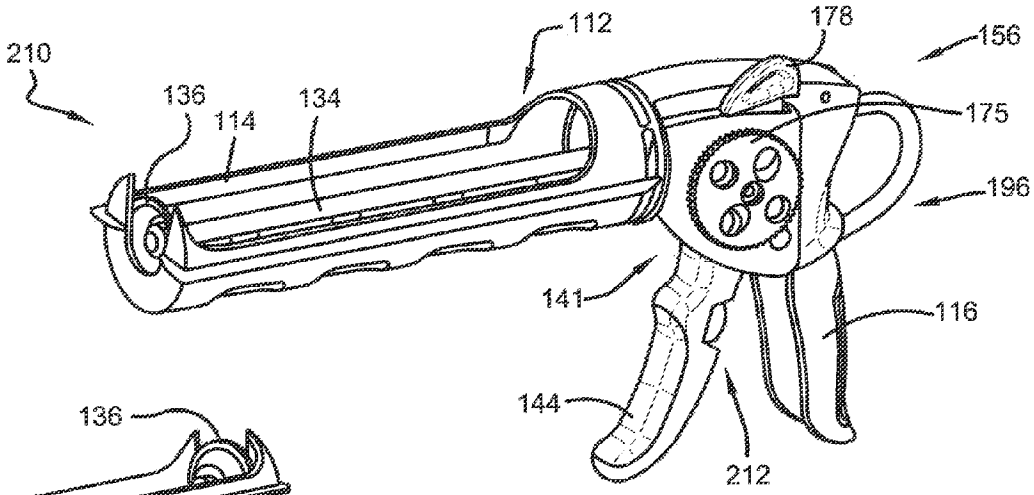
FIG. 15A is a first side view of a caulking gun.
Figure 15B:
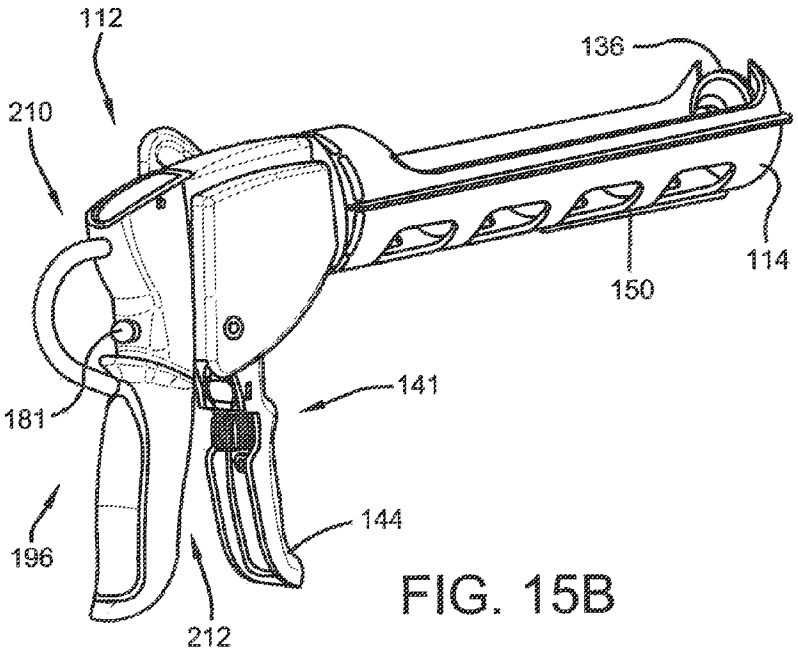
FIG. 15B is a second side view of the caulking gun shown in FIG. 15A.
Figure 16C:
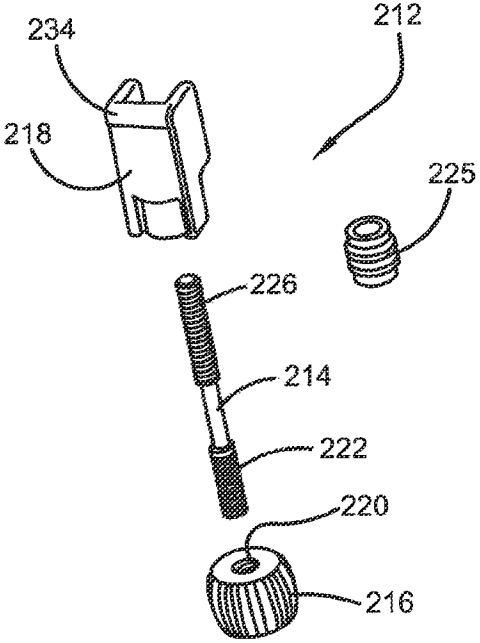
FIG. 16C is an assembly view of the adjustable thrust mechanism shown in FIG. 16B.
Figure 16B:
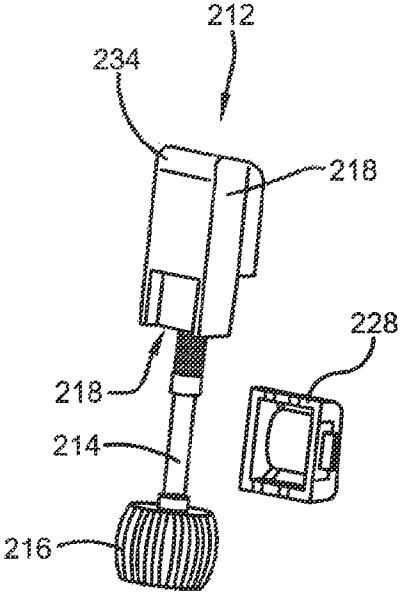
FIG. 16B is a perspective view of an adjustable thrust mechanism shown in FIG. 16A.
Figure 16A:
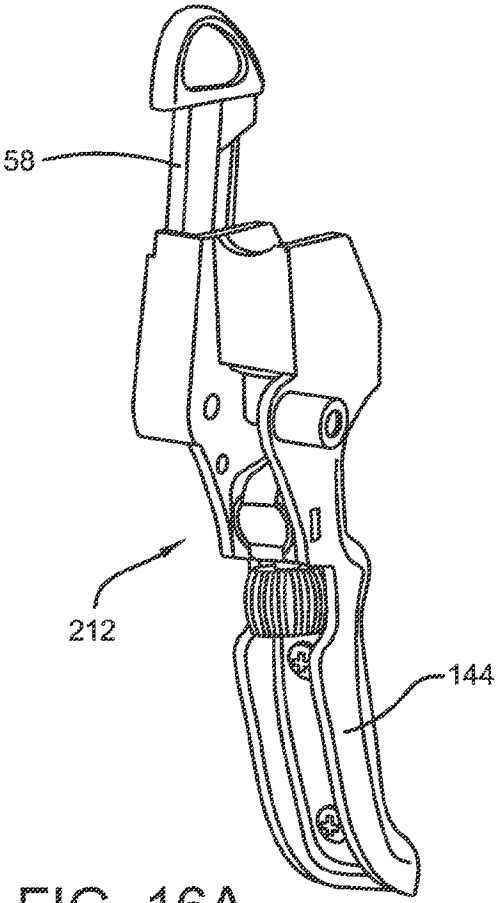
FIG. 16A is a perspective view of a trigger with an adjustable thrust mechanism.
Figure 17:
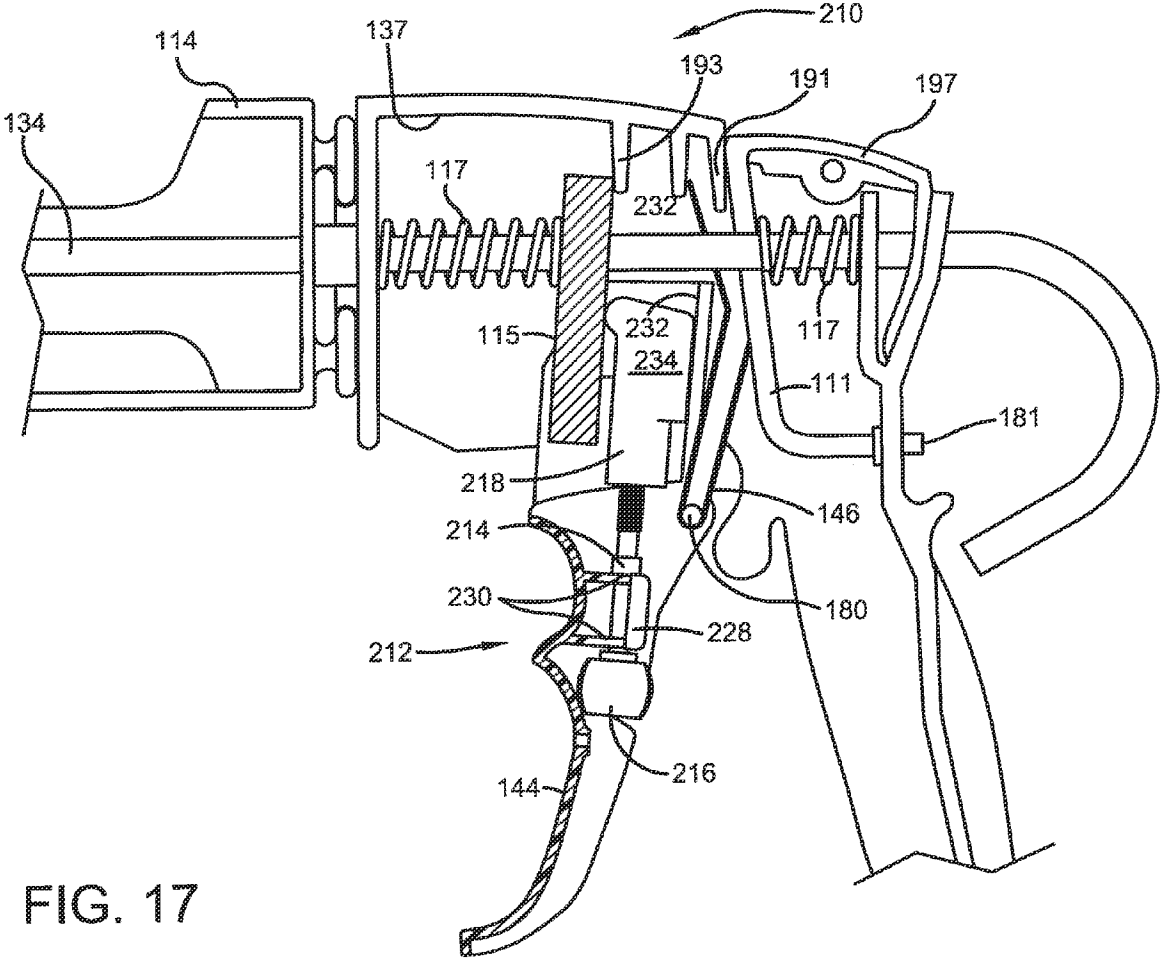
FIG. 17 is a longitudinally sectional view of the caulking gun shown in FIG. 15A.

With reference now to FIGS. 15-17, another caulking gun 210 that includes some embodiments of this invention will now be described. Caulking gun 210 has many components that are similar to those described above regarding caulking gun 110 and thus many reference numbers are identical. Because the use and operation of those features has been described above, they will not be repeated here. The emphasis will instead be on the distinctions between caulking gun 210 and caulking gun 110. While the body 112 may be formed in any manner and of any material chosen with the sound judgment of a person of skill in the art, for the embodiment shown the body 112, both the tube housing 114 and the handgrip 116, are formed of cast aluminum. Caulking gun 210 may include an adjustable thrust mechanism 212 that can be used to adjust the thrust or force applied by the trigger 144 to the second dog plate 115 and thus to the piston rod 134 when the user moves the trigger 144.

With continuing reference to FIGS. 15-17, the adjustable thrust mechanism 212 may include a shaft 214, a thumbwheel knob 216, and a control cam 218. The thumbwheel knob 216 may have an opening 220 that receives a first end 222 of the shaft 214. In one embodiment, the first end 222 is knurled or splined to create a press fit with the thumbwheel knob 21.6. The control cam 218 may have an opening 224 that receives a threaded insert that engages threads formed on the outer surface of a second end 226 of the shaft 214. The shaft 214 may be rotatably received in extensions 230, 230 formed on the trigger 144. A retainer 228 may be used to secure the shaft 214 to the trigger 144. When assembled, as shown in FIG. 17, the proximal side of the control cam 218 abuts the distal side of a wall 232 that may be fixed to the interior of the trigger 144 and the distal side of the control cam 218 abuts the proximal side of the second dog plate 115. The control cam 218 may have a contact surface 234 that extends from an upper portion of the distal side and may be used as the primary contact surface of the control cam 218 with the dog plate 115. As understood by those of skill in the art, the force or thrust ratio applied by the trigger 144 to the dog plate 115 (and thus to the piston rod 134) as the trigger 144 is pivoted about pivot pin 180, is proportional to the distance the control cam 218 is extended along the longitudinal axis of the shaft 214. Thus, when the user rotates the thumbwheel knob 216 to rotate the shaft 214, the control cam 218 is moved up and down (depending on which way the thumbwheel knob 216 is rotated) and the thrust ratio applied by the trigger 144 is changed accordingly. The trigger 144 may have a cut out area, as shown, that exposes the knob 216 for easy access by a user. The knob 216 shown is infinitely variable, by rotating the knob, within a predetermined range, the maximum movement of the control cam 218. As non-limiting examples only, a caulking gun similar to that shown in FIGS. 1-4 was constructed and its thrust ratio was approximately 8 to 1. A caulking gun similar to that shown in FIGS. 8-9 was constructed and its thrust ratio was approximately 12 to 1. Similarly, a caulking gun similar to that shown in FIGS. 15-17 was constructed and the adjustable thrust mechanism 212 enabled the thrust ratio to be adjusted anywhere within the range of 26 to 1 and 8 to 1.

Numerous embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

We claim:

1. A caulking gun for use with an associated caulk tube comprising a canister and a dispensing tip through which caulk material in the canister is dispensed, the caulking gun comprising:

a body having a tube housing for housing the associated caulk tube while caulk material is dispensed;

a piston assembly that is supported to the body and that comprises: (1) a piston rod; and, (2) a piston attached to the piston rod;

a trigger mechanism that is supported to the body and that comprises: (1) a trigger that: (a) comprises a contact surface; and, (b) is movable with respect to the body; and (2) an advance plate that grips the piston rod;

a tip cutter mechanism including a first plate fixedly mounted to the body and having at least one tip reception opening, and a second plate movably supported to the body and having at least two tip reception openings such that the second plate may be moved to align any one tip reception opening with the tip reception opening of the first plate, comprising a blade having a cutting edge;

wherein the trigger mechanism is operable by moving the trigger with respect to the body to contact the advance plate with the second contact surface of the control cam to move the piston rod and the piston to cause the caulk material to dispense through the dispensing tip; and, wherein when the dispensing tip is positioned properly with respect to the blade, the blade is movable with respect to the body, while being supported to the body, to contact the dispensing tip with the cutting edge and cut the dispensing tip of the associated caulk tube to adjust the amount of caulk material that is dispensed.

2. The Caulking gun of claim 1 wherein,

The tip cutter mechanism second plate comprises a wheel having at least a first tip reception opening and a second tip reception opening with a shape different to the first tip reception opening;

the wheel is rotatably connected to the body and can be rotated between a first position where the first tip reception opening is positioned to permit a tip to be cut, and a second position where the second tip reception opening is positioned to permit a tip to be cut.

3. The caulking gun of claim 1 wherein the tip cutter mechanism comprises a blade holder assembly comprising:

the blade;

a blade holder having an engagement feature that matches an engagement feature on the blade to ensure that only a correct blade can be engaged to the blade holder;

a blade holder sleeve that is pivotally attached to the body;

wherein after the blade is engaged to the blade holder, the blade holder is insertable into the blade holder sleeve; and, wherein the blade holder assembly is pivotal with respect to the body, while being supported to the body, to contact the dispensing tip with the cutting edge and cut the dispensing tip of the associated caulk tube to adjust the amount of caulk material that is dispensed.

4. The caulking gun of claim 1 wherein:

the blade has a shape;

the blade holder comprises: (1) a cutout area sized to match the shape of the blade; (2) a handle; and, (3) a notch that exposes the cutting edge to contact the dispensing tip; and, the blade holder sleeve comprises a notch that exposes the cutting edge to contact the dispensing tip.

5. A caulking gun for use with an associated caulk tube comprising a canister and a dispensing tip through which caulk material in the canister is dispensed, the caulking gun comprising:

a body having a tube housing for housing the associated caulk tube while caulk material is dispensed;

a tip cutter mechanism including a first plate fixedly mounted to the body and having at least one tip reception opening, and a second plate movably supported to the body and having at least two tip reception openings such that the second plate may be moved to align any one tip reception opening with the tip reception opening of the first plate, comprising a blade having a cutting edge; and, wherein when the dispensing tip is positioned properly with respect to the blade, the blade is movable with respect to the body, while being supported to the body, to contact the dispensing tip with the cutting edge and cut the dispensing tip of the associated caulk tube to adjust the amount of caulk material that is dispensed.

6. The caulking gun of claim 5 wherein:

at least one tab is received in at least one tab receiving slot to hold the blade cover in a fixed position to the body;

the second tip reception opening has a shape different from a shape of the first tip reception opening;

the dispensing tip is properly positioned with respect to the blade when the dispensing tip is extended into the first tip reception opening;

the dispensing tip is also properly positioned with respect to the blade when the dispensing tip is extended into the second tip reception opening;

when the dispensing tip is extended into the first tip reception opening, the blade is movable with respect to the body to cut the dispensing tip to obtain a first dispensing characteristic for the caulking material as it is dispensed from the canister; and, when the dispensing tip is extended into the second tip reception opening, the blade is movable with respect to the body to cut the dispensing tip to obtain a second dispensing characteristic for the caulking material as it is dispensed from the canister that is significantly different from the first dispensing characteristic.

7. The caulking gun of claim 5 wherein,

The tip cutter mechanism second plate comprises a wheel having at least a first tip reception opening and a second tip reception opening with a shape different to the first tip reception opening;

the wheel is rotatably connected to the body and can be rotated between a first position where the first tip reception opening is positioned to permit a tip to be cut, and a second position where the second tip reception opening is positioned to permit a tip to be cut.

8. The caulking gun of claim 5 wherein the tip cutter mechanism comprises a blade holder assembly comprising:

the blade;

a blade holder having an engagement feature that matches an engagement feature on the blade to ensure that only a correct blade can be engaged to the blade holder;

a blade holder sleeve that is pivotally attached to the body;

wherein after the blade is engaged to the blade holder, the blade holder is insertable into the blade holder sleeve; and, wherein the blade holder assembly is pivotal with respect to the body, while being supported to the body, to contact the dispensing tip with the cutting edge and cut the dispensing tip of the associated caulk tube to adjust the amount of caulk material that is dispensed.

9. The caulking gun of claim 5 wherein:

the blade has a shape;

the blade holder comprises: (1) a cutout area sized to match the shape of the blade; (2) a handle; and, (3) a notch that exposes the cutting edge to contact the dispensing tip; and, the blade holder sleeve comprises a notch that exposes the cutting edge to contact the dispensing tip.

10. A method of cutting the tip of a caulk tube comprising the steps of:

(A) providing a caulk tube comprising: (1) a canister; and (2) and a dispensing tip through which caulk material in the canister is dispensed;

(B) providing a caulking gun comprising: (1) a body having a tube housing that houses the caulk tube while caulk material is dispensed; and, (2) a tip cutter mechanism including a first plate fixedly mounted to the body and having at least one tip reception opening, and a second plate movably mounted to the body and having at least two tip reception openings such that the second plate may be moved to align any one tip reception opening with the tip reception opening of the first plate, and further comprising a blade that: (a) is supported to the body; and, (b) has a cutting edge;

(C) positioning the dispensing tip properly with respect to the blade;

(D) moving the blade with respect to the body, while being supported to the body, to contact the dispensing tip with the cutting edge and cut the dispensing tip to adjust the amount of caulk material that is dispensed.

11. The method of claim 10 wherein:

step (B) comprises the step of: providing the caulking gun with a blade cover that: (1) is fixed to the body; (2) covers the blade; (3) comprises a first tip reception opening having a shape; and, (4) comprises a second tip reception opening having a shape different from the shape of the first tip reception opening;

step (C) comprises the step of: positioning the dispensing tip into one of the first tip reception opening and the second tip reception opening; and, step (D) comprises the step of: obtaining a first dispensing characteristic for the caulking material as it is dispensed from the canister when the dispensing tip is positioned in the first tip reception opening; and, obtaining a second dispensing characteristic that is significantly different from the first dispensing characteristic for the caulking material as it is dispensed from the canister when the dispensing tip is positioned in the second tip reception opening.

12. The method of claim 10 wherein:

step (B) comprises the step of: providing the caulking gun with a wheel that: (1) is rotatably connected to the body; (2) comprises a first tip reception opening having a shape; and, (3) comprises a second tip reception opening having a shape different from the shape of the first tip reception opening;

step (C) comprises the step of: rotating the wheel with respect to the body into one of: (a) a first position where the dispensing tip is properly positioned with respect to the blade when the dispensing tip is extended into the first tip reception opening; and, (b) a second position where the dispensing tip is properly positioned with respect to the blade when the dispensing tip is extended into the first tip reception opening; and, step (D) comprises the step of: obtaining a first dispensing characteristic for the caulking material as it is dispensed from the canister when the dispensing tip is positioned in the first tip reception opening; and, obtaining a second dispensing characteristic that is significantly different from the first dispensing characteristic for the caulking material as it is dispensed from the canister when the dispensing tip is positioned in the second tip reception opening.

13. The method of claim 10 wherein:

step (B) comprises the steps of:

providing the blade with an engagement feature;

providing the tip cutter mechanism with: a blade holder having an engagement feature that matches the engagement feature of the blade; and a blade holder sleeve that is pivotally attached to the body;

engaging the engagement feature of the blade to the engagement feature of the blade holder to ensure that only a correct blade can be engaged to the blade holder;

after step (B) but before step (C) the method comprises the step of: inserting the blade holder and blade into the blade holder sleeve; and, step (D) comprise the step of pivoting the tip cutter mechanism with respect to the body, while being supported to the body, to contact the dispensing tip with the cutting edge and cut the dispensing tip to adjust the amount of caulk material that is dispensed.

14. The method of claim 10 wherein:

after step (B) but before step (C) the method comprises the step of: removing the caulk tube from the tube housing of the body; and, after step (D) the method comprises the step of: positioning the caulk tube onto the tube housing of the body.

* * * * *

UNITED STATES PATENT AND TRADEMARK OFFICE

CERTIFICATE OF CORRECTION

PATENT NO. : 8,904,910 B2
APPLICATION NO. : 13/723836
DATED : December 9, 2014
INVENTOR(S) : Andrew K. Marsden et al.

It is certified that error appears in the above-identified patent and that said Letters Patent is hereby corrected as shown below:

In the Specification

Figure 10A:
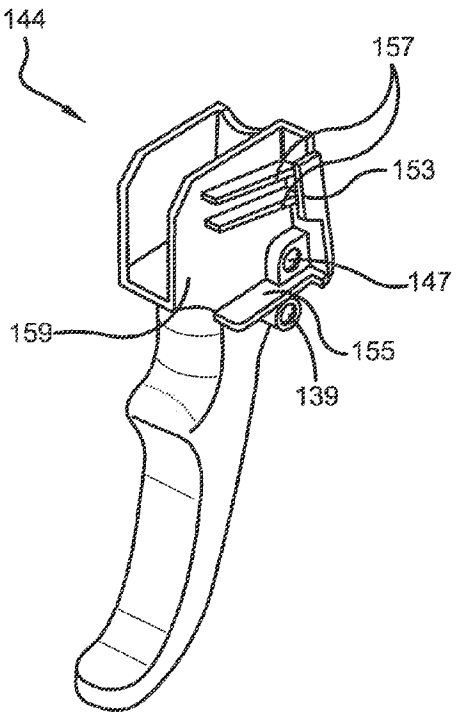
FIG. 10A is a perspective view of a trigger.
Figure 11B:
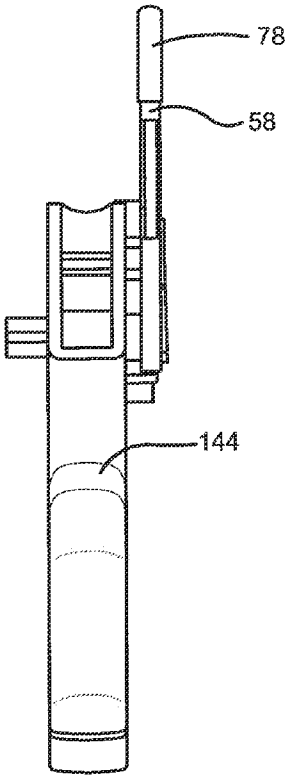
FIG. 11B is an end view of the trigger shown in FIG. 11A.
Figure 11A:
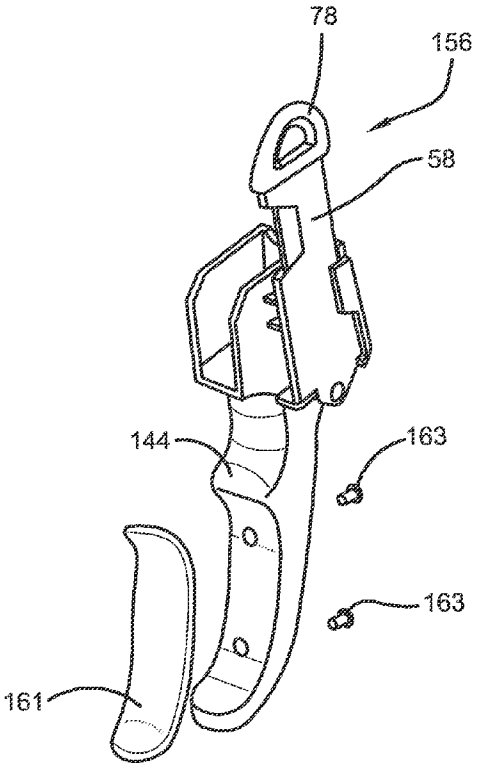
FIG. 11A is a perspective view of a trigger with a blade holder assembly.
Figure 12B:
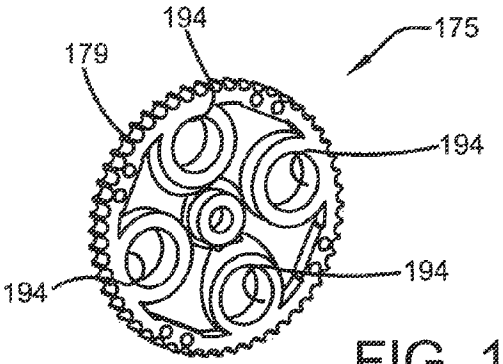
FIG. 12B is a second side perspective view of the cut-off wheel shown in FIG. 12A.
Figure 12A:
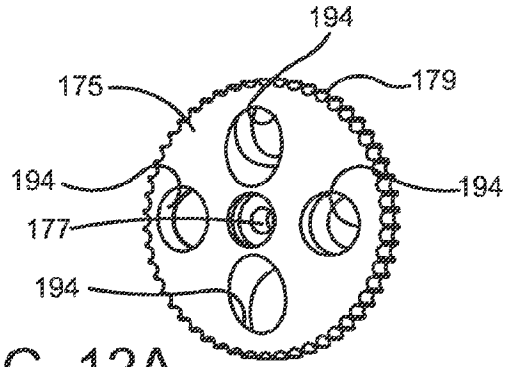
FIG. 12A is a first side perspective view of a cut-off wheel.
Figure 12G:
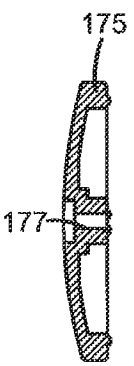
FIG. 12G is a sectional view taken along the line 12G-12G in FIG. 12D.
Figure 12F:
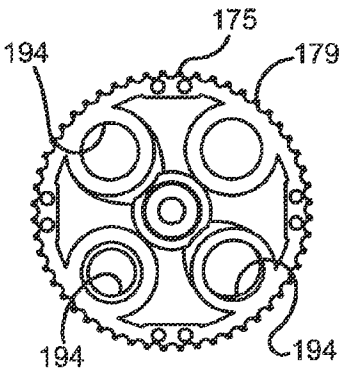
FIG. 12F is a second side view of the cut-off wheel shown in FIG. 12A.
Figure 12E:
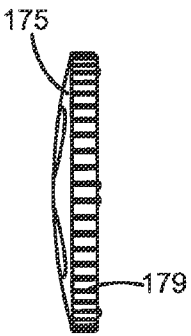
FIG. 12E is a second end view of the cut-off wheel shown in FIG. 12A.
Figure 12D:
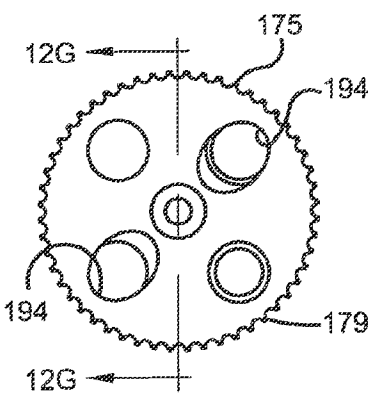
FIG. 12D is a first side view of the cut-off wheel shown in FIG. 12A.
Figure 12C:
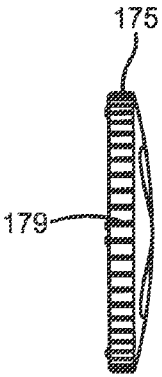
FIG. 12C is a first end view of the cut-off wheel shown in FIG. 12A.
Figure 13C:
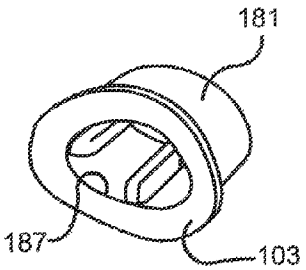
FIG. 13C is a second side perspective view of the button shown in FIG. 13B.
Figure 13B:
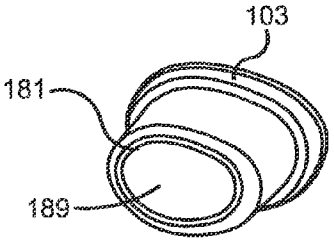
FIG. 13B is a first side perspective view of a button.
Figure 13A:
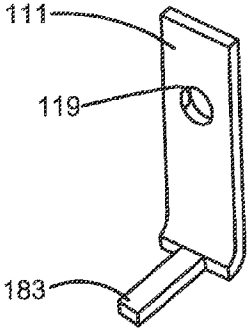
FIG. 13A is a perspective view of a dog plate.
Figure 13D:
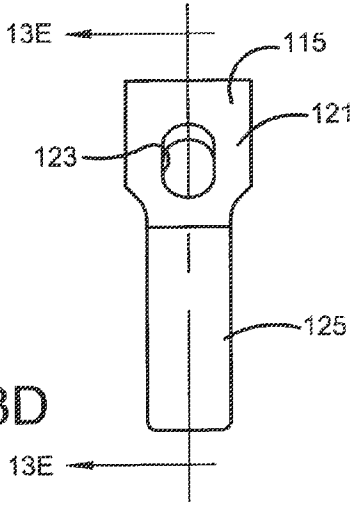
FIG. 13D is a side perspective view of a dog plate.
Figure 13E:
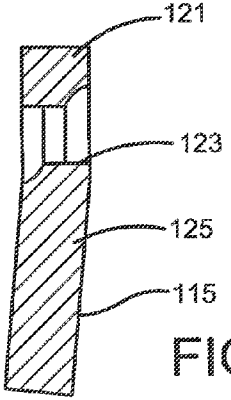
FIG. 13E is a sectional view taken along the line 13E-13E in FIG. 13D.
Figure 14B:
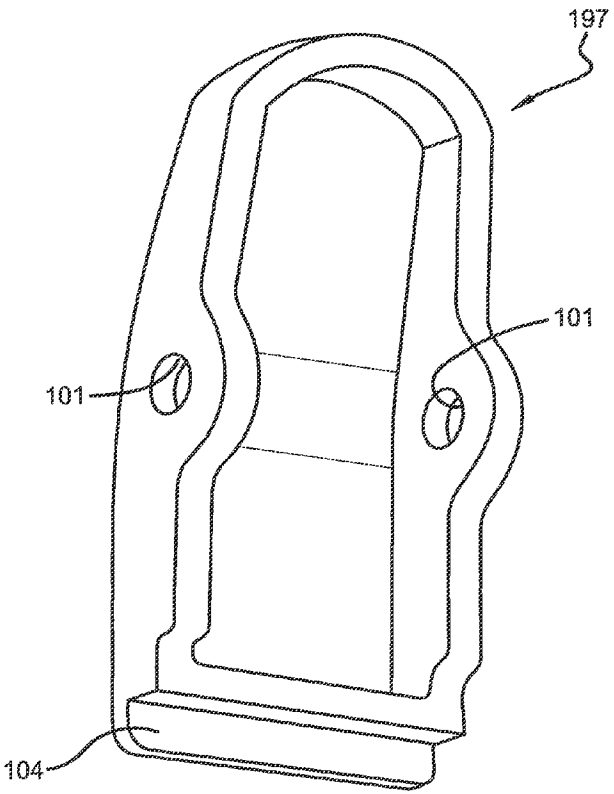
FIG. 14B is a second side perspective view of the lever shown in FIG. 14A.
Figure 14A:
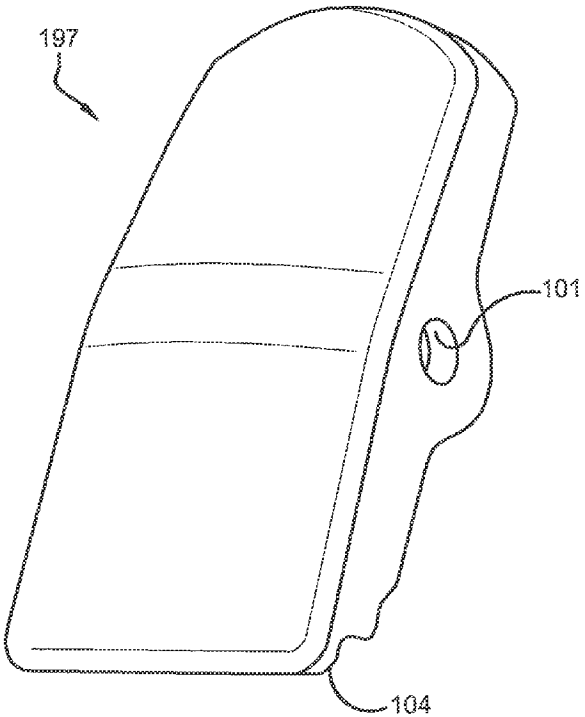
FIG. 14A is a first side perspective view of a lever.

Column 2, Line 44, delete “FIG 100” and insert --FIG 10A--.

Column 7, Line 58, delete “8-41” and insert --8-11--.

Column 8, Line 27, delete “841” and insert --8-11--.

Signed and Sealed this
Twenty-first Day of April, 2015

Michelle K. Lee

Michelle K. Lee
*Director of the United States Patent and Trademark Office*